United States Patent [19]

Narita

[11] Patent Number: 4,935,855

[45] Date of Patent: Jun. 19, 1990

[54] SEARCHLIGHT LAMP TILTING MECHANISM

[75] Inventor: Yuichi Narita, Urawa, Japan

[73] Assignee: Sanshin Dengu Manufacturing Co., Ltd., Tokyo, Japan

[21] Appl. No.: 305,933

[22] Filed: Feb. 2, 1989

[30] Foreign Application Priority Data

Feb. 9, 1988 [JP] Japan ..... 63-15214[U]

[51] Int. Cl.[5] ..... F21V 19/02

[52] U.S. Cl. ..... 362/286; 362/287; 362/418; 362/428; 362/372

[58] Field of Search ..... 362/287, 418, 427, 428, 362/429, 319, 322, 269, 270, 271, 272, 285, 286, 372

[56] References Cited

U.S. PATENT DOCUMENTS

| | | | |
|---|---|---|---|
| 1,286,269 | 12/1918 | Foley | 362/284 |
| 1,423,253 | 7/1922 | Post | 362/321 |
| 3,758,769 | 9/1973 | Pichel | 362/264 |
| 4,065,806 | 12/1977 | Satch | 362/419 |
| 4,217,631 | 8/1980 | Bergkvist | 362/324 |
| 4,353,110 | 10/1982 | Ellis | 362/35 |
| 4,482,939 | 11/1984 | Tishman | 362/285 |

FOREIGN PATENT DOCUMENTS

| | | | |
|---|---|---|---|
| 2137320 | 2/1972 | Fed. Rep. of Germany | 362/428 |
| 2141302 | 3/1973 | Fed. Rep. of Germany | 362/285 |
| 2339837 | 2/1975 | Fed. Rep. of Germany | 362/428 |

*Primary Examiner*—Stephen F. Husar
*Assistant Examiner*—D. M. Cox
*Attorney, Agent, or Firm*—Kane, Dalsimer, Sullivan, Kurucz, Levy, Eisele and Richard

[57] ABSTRACT

A lamp tilting mechanism for a searchlight in which a light source including a lamp, a reflector, a socket and a socket holder is supported so as to be rotatable around a horizontal axis in a housing of the searchlight. Disposed behind the light source within the housing is a motor having a horizontal output shaft to which an arm-like slotted lever is fixed at one end. A horizontal pin is received loosely in the slot and fixed at an end to the light source whereby when the motor rotates, the light beams are tilted.

2 Claims, 3 Drawing Sheets

SEARCHLIGHT LAMP TILTING MECHANISM

BACKGROUND OF THE INVENTION

The present invention relates searchlight lamp tilting or elevating mechanisms for tilting or elevating light beams from a searchlight in a vertical plane.

In one conventional searchlight lamp tilting mechanism, a light source including a lamp, a reflector and a socket is supported rotatably around a horizontal axis. A sectoral toothed segment is fixed at a rear end of the light source, and a pinion meshing with the segment is attached to the output shaft of a motor. When the motor rotates the pinion, the toothed segment is moved vertically to thereby rotate the light source within a predetermined angle around the horizontal axis.

This mechanism, however, has the defect that if the searchlight is attached, for example, to a ship, and subjected invariably to possible vibrations, the teeth of the segment and pinion would be worn. If the toothed segment and pinion are made of a plastic material, the teeth may be broken by the vibrations.

It is necessary to cause the segment and pinion to mesh accurately with each other because if a possible backlash between the meshing teeth is small, the friction between the teeth is large, so that it is impossible to rotate the pinion by the force of the motor. If the backlash is large, vibrations would cause a backlash to thereby break and wear the teeth and swing the light beams.

It is therefore an object of the present invention to provide a searchlight lamp tilting mechanism which is free from a failure such as would occur due to possible abrasion and breakage of the teeth in the conventional technique, and easy to assemble.

SUMMARY OF THE INVENTION

According to the present invention, the above object is achieved by a lamp tilting mechanism for a searchlight in which a light source including a lamp, a reflector, a socket and a socket holder is rotated around a horizontal axis in a housing of the searchlight in order to vertically move the light beams from the searchlight, comprising:

means for supporting the light source within the housing so as to be rotatable around the horizontal axis;

a motor disposed behind the light source within the housing such that the output shaft of the motor is horizontal;

an arm-like lever having a slot therein and fixed at one end to the output shaft; and a horizontal pin received loosely in the slot and fixed at a rear end to the light source.

When the lever is rotated by the motor, the pin moves vertically in the slot in the lever, so that the light source with the pin is rotated around the horizontal axis to thereby tilt the light beam vertically.

DETAILED DESCRIPTION

Figure 1:
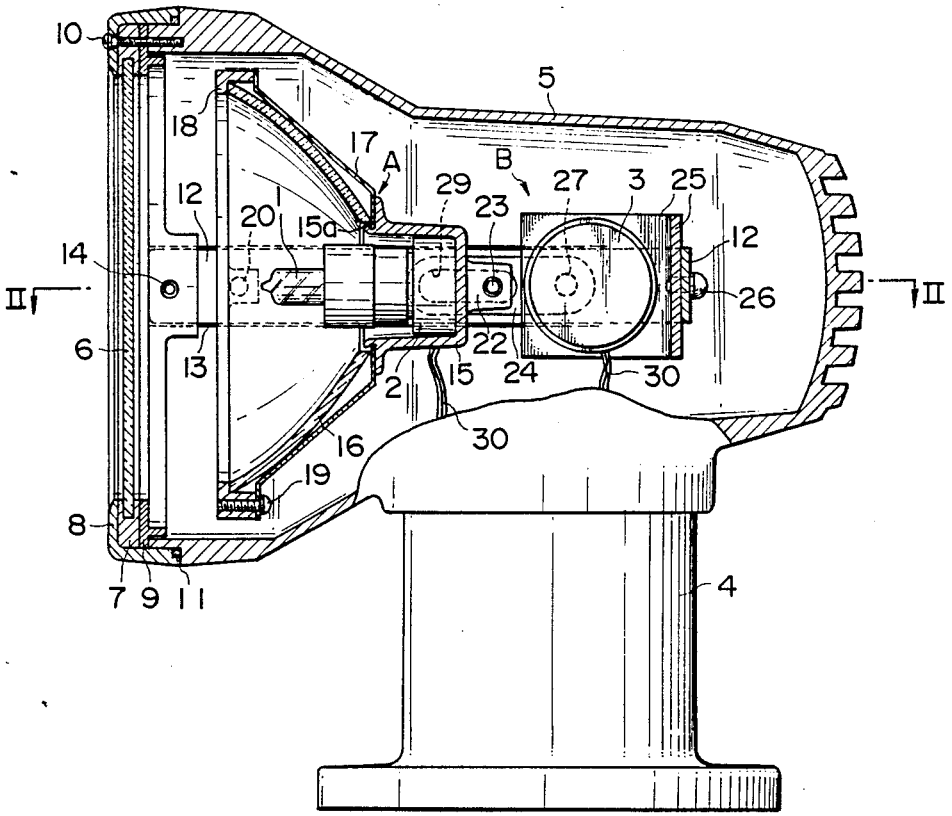
FIG. 1 is a partial elevational cross section view of a searchlight with a lamp tilting mechanism according to the present invention.
Figure 2:
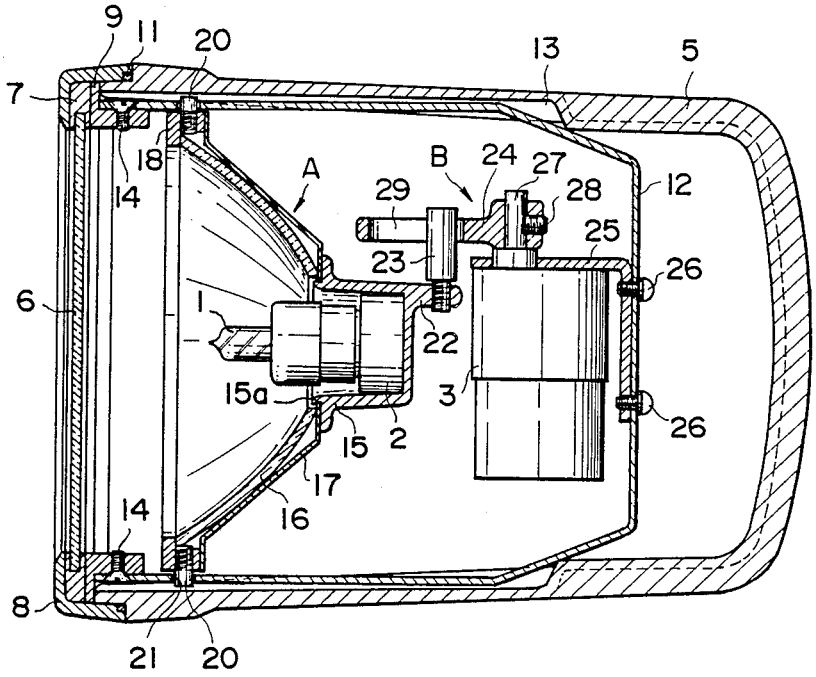
FIG. 2 is a partial horizontal cross section view of the searchlight taken along line II—II in FIG. 2.

An embodiment of the present invention will now be described in more detail with reference to the drawings. FIGS. 1 and 2 are a partial elevational cross section view and a partial horizontal cross section view, respectively, of a searchlight with a lamp tilting mechanism according to the present invention in which a lamp 1, a socket 2, a motor 3 and a base 4 are shown not sectioned. The base 4 is fixed to a searchlight mount (not shown) and has thereon a housing 5 rotatable around a substantially vertical axis. A rotation drive mechanism such as a motor, a rotational shaft, etc., (not shown) is built in the base 4.

Provided in the housing 5 are a light source A and a lamp tilting mechanism B with the front of the housing 5 being closed by a front glass plate 6 fitted into an inner peripheral groove in a ring-like front glass packing 7, which is held between a front frame 8 and a hold ring 9. The packing 7, front frame 8 and hold ring 9 are firmly secured together by a plurality of, for example three, equispaced screws 10 to the front periphery of the housing. An O-ring seal 11 is provided between the housing 5 and the front frame 8.

The light source A and the lamp tilting mechanism B are supported by a U-like support frame 12, which is slidably inserted into a recess 13 formed in an inner surface of the housing 5 so as to extend from its front end toward its rear end, and fixed at the front end thereof by screws 14 to the hold ring 9.

The light source A includes the lamp 1, the socket 2, a socket holder 15, a reflector 16, the cover 17 and a ring-like reflector holder 18. The lamp 1 is inserted in and held by the socket 2, which is fixed within the socket holder 15. The reflector 16 is held between the inner periphery of the cover 17 (the right-hand portion in FIGS. 1 and 2 and the reflector holder 18. The reflector cover 17 is held at its inner periphery by a bent step 15*a*on the socket holder 15 and fixed at its outer periphery (left-hand portion in FIGS. 1 and 2) to the reflector holder 18, for example, by three equispaced screws 19. Threadedly fixed to the reflector holder 18 are a pair of opposing horizontal threaded pins 20 which are also received rotatably in the corresponding holes 21 in the support plate 12. Therefore, the whole light source A is rotatable around the pins 20.

Formed at a rear end of the socket holder 15 is a tongue-like protrusion 22 in which a threaded pin 23 is threadedly fixed. The pin 23, motor 3 and lever 24 constitute the lamp tilting mechanism B. The motor 3, which has built-in reduction gears, is fixed to the support frame 12 by screws 26 through an L-like attachment plate 25. A lever 24 is fixed to a horizontal output shaft 27 of the motor 3 by a screw 28 so as not to make a relative rotation and has a slot 29 in which the pin 23 is loosely fitted. Reference numeral 30 denotes electric wires through which electric power is supplied from a power source (not shown) to the lamp 1 and motor 3.

Figure 3:
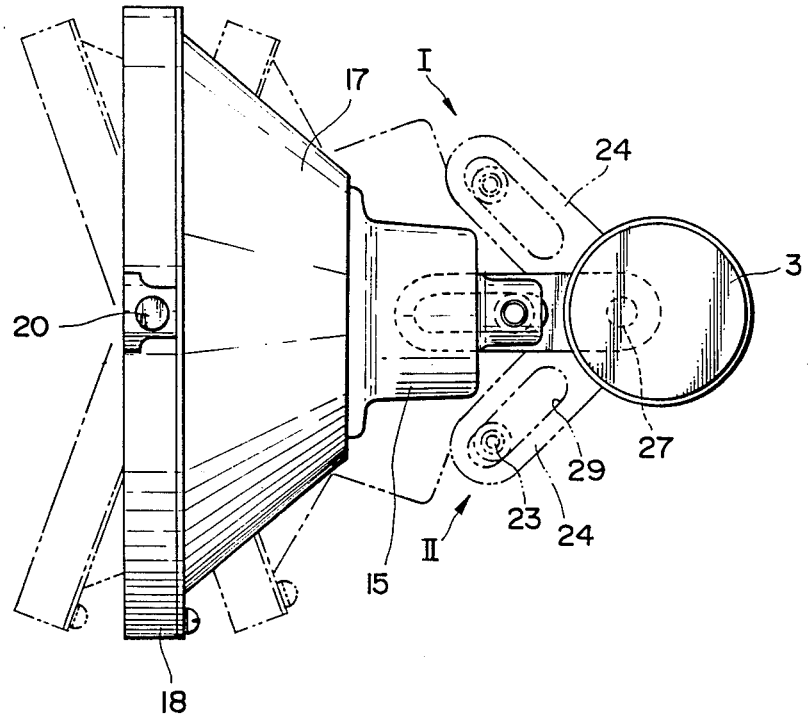
FIG. 3 illustrates the operation of the lamp tilting mechanism.

The adjustment of an angle of elevation or dip of searchlight beams by the tilting mechanism will now be described with reference to FIG. 3. If the motor 3 is started by pushing a button (not shown), the rotational movement of the motor is decelerated by the reduction gears and transmitted though the output shaft 27 to the lever 24. Thus the lever 24 is rotated around the output shaft 27 to thereby move the pin 23 vertically in the slot 29. Therefore, the light source A is swung around the horizontal shafts 20 as shown in FIG. 3 to thereby move vertically the light beams from the searchlight. In FIG. 3, reference character I denotes a maximum-elevation position and reference character II denotes a maximum-dip position. When the lever 24 is rotated to the position I or II, it hits on a stop (not shown) and does not rotate any longer. At that time, the motor 3 is locked and does not rotate any longer. It may be arranged that when the lever 24 arrives at the maximum-elevation and -dip positions I and II, it may actuate a limit switch (not shown) to stop the motor 3. The slot 29 in the lever 24 may be open at its leading end.

As described above, according to the inventive searchlight lamp tilting mechanism, the pin attached to the light source is received loosely in the slot in the lever, which is rotated by the motor to thereby rotate the light source around the horizontal axis. Therefore, it is free from the problem of abrasion and breakage of the meshing teeth with the conventional mechanism, and unlikely to fail. In addition, fine adjustment is not needed when the searchlight lamp tilting mechanism is assembled, so that assembling is easy.

I claim:

1. A lamp tilting mechanism for a searchlight in which a light source including a lamp, a reflector, a socket and a socket holder is rotated around a horizontal axis in a housing of the searchlight in order to vertically move the light beam from the searchlight, comprising:

means for supporting the light source within the housing so as to be rotatable around the horizontal axis;

a motor disposed behind the light source within the housing such that the output shaft of the motor is horizontal;

an arm-like lever having a slot therein and fixed at one end to the output shaft for rotation therewith; and a horizontal pin received loosely in the slot and fixed at a rear end to the light source.

2. A lamp tilting mechanism according to claim 1, including said tongue-like protrusion formed at a rear end of the socket holder of the light source, and a horizontal pin is attached to the protrusion.

* * * * *